US009429890B2

(12) United States Patent
Yamada et al.

(10) Patent No.: US 9,429,890 B2
(45) Date of Patent: Aug. 30, 2016

(54) FIXING DEVICE, IMAGE FORMING APPARATUS AND FIXING METHOD

(71) Applicant: Konica Minolta, Inc., Chiyoda-ku, Tokyo (JP)

(72) Inventors: Chiaki Yamada, Ibaraki (JP); Junya Hirayama, Takarazuka (JP); Hirofumi Nakagawa, Takatsuki (JP)

(73) Assignee: KONICA MINOLTA, INC, Chiyoda-Ku, Tokyo (JP)

( * ) Notice: Subject to any disclaimer, the term of this patent is extended or adjusted under 35 U.S.C. 154(b) by 0 days.

(21) Appl. No.: 15/001,601

(22) Filed: Jan. 20, 2016

(65) Prior Publication Data

US 2016/0223969 A1 Aug. 4, 2016

(30) Foreign Application Priority Data

Jan. 29, 2015 (JP) ..... 2015-015382

(51) Int. Cl.
*G03G 15/20* (2006.01)

(52) U.S. Cl.
CPC ..... *G03G 15/2064* (2013.01); *G03G 15/2078* (2013.01)

(58) Field of Classification Search
CPC ..... G03G 15/2064; G03G 15/2078
USPC ..... 399/69, 328
See application file for complete search history.

(56) References Cited

U.S. PATENT DOCUMENTS

2004/0057741 A1* 3/2004 Uehara ..... G03G 15/2064 399/69

FOREIGN PATENT DOCUMENTS

| | | | |
|---|---|---|---|
| JP | 9-160405 | A | 6/1997 |
| JP | 2005-338807 | A | 12/2005 |
| JP | 2006-154608 | A | 6/2006 |
| JP | 2006-250979 | A | 9/2006 |
| JP | 2012-68665 | A | 4/2012 |

* cited by examiner

*Primary Examiner* — Hoang Ngo
(74) *Attorney, Agent, or Firm* — Buchanan Ingersoll & Rooney PC

(57) ABSTRACT

There is provided a fixing device for fixing a toner image formed on a surface of a recording medium by toner, wherein the toner includes a releasing agent and satisfies $T_a<T_b$, where $T_a$ (° C.) represents a melting point of the releasing agent and $T_b$ (° C.) represents a temperature at which an elastic modulus of the toner is $1\times10^4$ Pa, the fixing device includes a first fixing portion and a second fixing portion in this order along a conveyance direction of the recording medium, the first fixing portion presses and heats the toner image such that a maximum temperature $T_{13}$ (° C.) of the surface of the recording medium satisfies $T_a\leq T_{13}<T_b$, and the second fixing portion presses and heats the toner image such that a maximum temperature $T_{23}$ (° C.) of the surface of the recording medium satisfies $T_{23}\geq T_b$.

14 Claims, 4 Drawing Sheets

FIXING DEVICE, IMAGE FORMING APPARATUS AND FIXING METHOD

This application is based on Japanese Patent Application No. 2015-015382 filed with the Japan Patent Office on Jan. 29, 2015, the entire content of which is hereby incorporated by reference.

BACKGROUND OF THE INVENTION

1. Field of the Invention

The present invention relates to a fixing device, an image forming apparatus using the fixing device, and a fixing method. Particularly, the present invention relates to a fixing device used to fix a toner image in an electrophotographic image forming apparatus.

2. Description of the Related Art

In an electrophotographic image forming apparatus, it is common to cause a powdery coloring material called "toner" to electrostatically adhere to a recording medium, and to heat and press the toner to fix the toner to the recording medium. Examples of the recording medium include a recording medium made of paper, a recording medium made of resin and used for an OHP or the like, and other types of recording media.

As a commonly-used conventional fixing method, there is a roller nip type method in which a recording medium having a toner image transferred thereonto is nipped and conveyed by two rollers, or a belt nip type method in which the recording medium is nipped and conveyed by an endless belt and rollers (Japanese Laid-Open Patent Publication No. 2012-068665 (Document 1), Japanese Laid-Open Patent Publication No. 09-160405 (Document 2), Japanese Laid-Open Patent Publication No. 2006-154608 (Document 3) and the like).

Document 1 describes a method for fixing a toner image by sequentially arranging a fixing device of belt nip type and a fixing device of roller nip type, and heating a recording medium to different temperatures by these fixing devices. Each of Documents 2 and 3 describes a method for fixing a toner image by nipping and conveying a recording medium by a heated belt in a fixing device of belt nip type. When a recording medium is conveyed with a roller or a belt being pressed in contact with the recording medium, the toner is heated and a releasing agent included in the toner seeps out, so that a toner image is fixed and at the same time the separation property between the toner image and the roller or the belt can be achieved (hereinafter also simply referred to as "fixation and separation property").

SUMMARY OF THE INVENTION

However, according to the methods described in Documents 1 to 3, the releasing agent in the toner did not seep out sufficiently and the excellent fixation and separation property was not obtained in some cases. These methods also had such a problem that the releasing agent remaining in the toner reduces the film strength of the toner image and reduces the fixation strength of the toner image (hereinafter also simply referred to as "fixation strength").

An object of the present invention is to provide a fixing device, an image forming apparatus and a fixing method, which achieve the excellent fixation and separation property and the high fixation strength.

The present invention is directed to a fixing device for fixing a toner image formed on a surface of a recording medium by toner, wherein the toner includes a releasing agent and satisfies $T_a<T_b$, where $T_a$ (° C.) represents a melting point of the releasing agent and $T_b$ (° C.) represents a temperature at which an elastic modulus of the toner is $1\times10^4$ Pa, the fixing device includes a first fixing portion and a second fixing portion in this order along a conveyance direction of the recording medium, the first fixing portion presses and heats the toner image such that a maximum temperature $T_{13}$ (° C.) of the surface of the recording medium satisfies $T_a\leq T_{13}<T_b$, and the second fixing portion presses and heats the toner image such that a maximum temperature $T_{23}$ (° C.) of the surface of the recording medium satisfies $T_{23}\leq T_b$.

Preferably, in the first fixing portion, a pressure applied to the recording medium is 300 kPa to 1000 kPa.

In one embodiment of the fixing device described above, the first fixing portion includes a first fixing member arranged on a front surface side of the recording medium, and a first pressing member arranged on a rear surface side of the recording medium, and the first fixing member and the first pressing member nip and convey the recording medium, and the second fixing portion includes a second fixing member arranged on the front surface side of the recording medium, and a second pressing member arranged on the rear surface side of the recording medium, and the second fixing member and the second pressing member nip and convey the recording medium.

Preferably, in one embodiment described above, temperatures of the first fixing member and the first pressing member are adjustable, and the temperature $T_{11}$ (° C.) of the first fixing member and the temperature $T_{12}$ (° C.) of the first pressing member are adjusted to satisfy $T_{11}>T_{12}$. In addition, preferably, a temperature of the second fixing member is adjustable, and the temperature $T_{21}$ (° C.) of the second fixing member is adjusted to satisfy $T_{21}\geq T_b$.

In one embodiment described above, the fixing device may include an interposed member that is in contact with the first fixing member and the second fixing member. For example, the interposed member is an endless belt, and in the first fixing portion and the second fixing portion, the recording medium is conveyed, with the interposed member abutting the surface of the recording medium. Alternatively, for example, each of the first fixing portion, the second fixing portion and the interposed member is a roller.

The present invention is also directed to an image forming apparatus including the fixing device described above.

The present invention is also directed to a fixing method for fixing a toner image formed on a recording medium by toner, wherein the recording medium is conveyed in the order of a first fixing step and a second fixing step, so that the toner image is fixed, the toner includes a releasing agent and satisfies $T_a<T_b$, where $T_a$ (° C.) represents a melting point of the releasing agent and $T_b$ (° C.) represents a temperature at which an elastic modulus of the toner is $1\times10^4$ Pa, in the first fixing step, the toner image is pressed and heated such that a maximum temperature $T_{13}$ (° C.) of a surface of the recording medium satisfies $T_a\leq T_{13}<T_b$, and in the second fixing step, the toner image is pressed and heated such that a maximum temperature $T_{23}$ (° C.) of the surface of the recording medium satisfies $T_{23}\geq T_b$.

Preferably, in the first fixing step, a pressure applied to the recording medium is 300 kPa to 1000 kPa.

In one embodiment of the fixing method described above, in the first fixing step, the recording medium is nipped and conveyed by a first fixing member arranged on a front surface side of the recording medium and a first pressing member arranged on a rear surface side of the recording medium, and in the second fixing step, the recording medium is nipped and conveyed by a second fixing member arranged on the front surface side of the recording medium and a second pressing member arranged on the rear surface side of the recording medium.

Preferably, in one embodiment described above, temperatures of the first fixing member and the first pressing member are adjustable, and in the first fixing step, the temperature $T_{11}$ (° C.) of the first fixing member and the temperature $T_{12}$ (° C.) of the first pressing member are adjusted to satisfy $T_{11}>T_{12}$. Preferably, in one embodiment described above, a temperature of the second fixing member is adjustable, and in the second fixing step, the temperature $T_{21}$ (° C.) of the second fixing member is adjusted to satisfy $T_{21}>T_b$.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
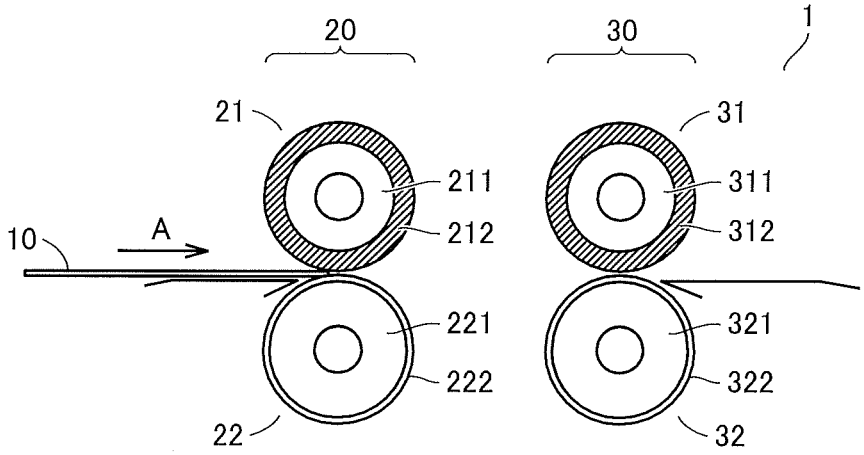
FIG. 1 is a cross-sectional view showing a schematic configuration of a fixing device of a first embodiment.

Embodiments related to the present invention (hereinafter simply referred to as "the present embodiment") will be described in more detail hereinafter. When the following embodiments are described with reference to the drawings, the same or corresponding portions are denoted by the same reference characters.

Fixing Device

First Embodiment

FIG. 1 is a cross-sectional view showing a schematic configuration of a fixing device of a first embodiment. A fixing device 1 includes a first fixing portion 20 and a second fixing portion 30 in this order along a conveyance direction A of a recording medium 10. First fixing portion 20 includes a heating roller (first fixing member) 21 arranged on the front surface side of recording medium 10, and a pressing roller (first pressing member) 22 arranged on the rear surface side of recording medium 10 so as to face heating roller 21. In first fixing portion 20, recording medium 10 is nipped and conveyed by heating roller 21 and pressing roller 22. Second fixing portion 30 includes a heating roller (second fixing member) 31 arranged on the front surface side of recording medium 10, and a pressing roller (second pressing member) 32 arranged on the rear surface side of recording medium 10 so as to face heating roller 31. In second fixing portion 30, recording medium 10 is nipped and conveyed by heating roller 31 and pressing roller 32. The front surface of recording medium 10 refers to a surface on which a toner image is formed by toner.

In first fixing portion 20 and second fixing portion 30, heating roller 21, 31 and pressing roller 22, 32 are pressed in contact with each other by a not-shown pressure-applying device (spring) and can be adjusted such that a desired pressure is attained.

Heating roller 21, 31 includes a cylindrical base member 211, 311 made of metal, and a rubber layer 212, 312 formed on a surface thereof. A releasing layer (not shown) is formed on a surface of rubber layer 212, 312. A heating member (not shown) for heating cylindrical base member 211, 311 is provided inside cylindrical base member 211, 311. The heating member is a glass tube heater having a filament and heats the whole of heating roller 21, 31 by radiating heat rays from inside cylindrical base member 211, 311. The temperature of heating roller 21, 31 is monitored by a temperature sensor (not shown) placed on a surface thereof and is fed back to a temperature control circuit, so that heating roller 21, 31 is controlled to a prescribed temperature.

A heat-resistant rubber material is used for rubber layer 212, 312 of the heating roller, and silicone rubber, acrylic rubber, fluorine rubber or the like is used. The thickness is preferably in the range of 5 to 50 mm, and a value of the hardness is preferably in the range of 5 to 60 in accordance with JIS K6253. A fluorine-based film having excellent heat resistance and releasing property is suitable as the releasing layer. Fluorine resin such as PTFE, or copolymer resin such as PFA is suitable as a material of the fluorine-based film.

Pressing roller 22, 32 includes a cylindrical base member 221, 321 made of metal, and a rubber layer 222, 322 formed on a surface thereof. A heating member (not shown) for heating cylindrical base member 221, 321 is provided inside cylindrical base member 221, 321. The heating member is a glass tube heater having a filament and heats the whole of pressing roller 22, 32 by radiating heat rays from inside cylindrical base member 221, 321. The temperature of pressing roller 22, 32 is monitored by a temperature sensor (not shown) placed on a surface thereof and is fed back to a temperature control circuit, so that pressing roller 22, 32 is controlled to a prescribed temperature.

A heat-resistant rubber material is used for rubber layer 222, 322 of the pressing roller, and silicone rubber, acrylic rubber, fluorine rubber or the like is used. The thickness is preferably in the range of 0.5 to 30 mm, and a value of the hardness is preferably in the range of 5 to 60 in accordance with JIS K6253.

In fixing device 1, based on the result of measurement by the not-shown temperature sensor, a maximum temperature $T_{13}$ (° C.) of the surface of recording medium 10 passing through first fixing portion 20 and a maximum temperature $T_{23}$ (° C.) of the surface of recording medium 10 passing through second fixing portion 30 can be obtained. Although the temperature transition of the surface of the recording medium varies depending on temperature control, the conveyance speed and the like in first fixing portion 20 and second fixing portion 30, the temperature transition normally exhibits temperature rise, arrival at the maximum temperature, and temperature fall in each fixing portion. As the temperature sensor for detecting the surface temperature of the recording medium, a noncontact temperature sensor such as an infrared sensor may, for example, be used.

Alternatively, the surface temperature of recording medium 10 may be measured by a fast responsive thermocouple affixed on recording medium 10. When the infrared sensor is used, the infrared sensor may be provided to preliminarily identify a position where the maximum temperature is reached, and detect a temperature at this position. Alternatively, the infrared sensor may be provided to detect temperatures at a plurality of positions and calculate the maximum temperature based on the temperatures detected at these positions. Alternatively, the infrared sensor may be provided to preliminarily detect a temperature at a position where a temperature difference from the maximum temperature is known, and calculate the maximum temperature based on the result of detection at this position.

The toner used to form the toner image on the surface of the recording medium is not particularly limited, as long as the toner is at least toner including a binder resin and a releasing agent and satisfying a relationship of $T_a<T_b$, where $T_a$ (° C.) represents a melting point of the releasing agent and $T_b$ (° C.) represents a temperature at which an elastic modulus of the toner is $1\times10^4$ Pa. The commercially available toner normally includes the releasing agent and satisfies the relationship of $T_a<T_b$.

In first fixing portion 20, the toner image is pressed and heated such that maximum temperature $T_{13}$ of the surface of recording medium 10 satisfies $T_a\leq T_{13}<T_b$. Namely, temperature control of heating roller 21 and pressing roller 22 is performed such that maximum temperature $T_{13}$ (° C.) of the surface satisfies $T_a\leq T_{13}<T_b$. For example, this temperature control can be achieved by appropriately controlling the temperature of heating roller 21 within the temperature range of equal to or higher than $T_a$ and lower than $T_b$+40° C. The present embodiment is configured such that both heating roller 21 serving as the first fixing member and pressing roller 22 serving as the first pressing member include the heating members and can be subjected to temperature control. However, the present invention may be configured such that only one of the first fixing member and the first pressing member includes the heating member and can be subjected to temperature control.

In second fixing portion 30, the toner image is pressed and heated such that maximum temperature $T_{23}$ (° C.) of the surface of recording medium 10 satisfies $T_{23}\geq T_b$. Namely, temperature control of heating roller 31 and pressing roller 32 is performed such that maximum temperature $T_{23}$ (° C.) of the surface satisfies $T_{23}\geq T_b$. For example, this temperature control can be achieved by appropriately controlling the temperature of heating roller 31 within the temperature range of equal to or higher than $T_b$+40° C. The present embodiment is configured such that both heating roller 31 serving as the second fixing member and pressing roller 32 serving as the second pressing member include the heating members and can be subjected to temperature control. However, the present invention may be configured such that only one of the second fixing member and the second pressing member includes the heating member and can be subjected to temperature control.

In fixing device 1, temperature control is performed in first fixing portion 20 and second fixing portion 30 as described above, and thus, the excellent fixation and separation property and the high fixation strength can be obtained. This is considered to be because in first fixing portion 20, the toner image is pressed and heated such that $T_a\leq T_{13}<T_b$ is satisfied, thereby allowing the releasing agent included in the toner to seep out sufficiently, and thereafter, in second fixing portion 30, the toner image is pressed and heated such that $T_{23}\geq T_b$ is satisfied, thereby allowing the toner image to be fixed sufficiently. Since the releasing agent having seeped out in first fixing portion 20 adheres to the surface of recording medium 10 and the surface of heating roller 21, the releasing agent enhances the separation property between recording medium 10 and heating roller 21 in first fixing portion 20 and enhances the separation property between recording medium 10 and heating roller 31 in second fixing portion 30.

In the present embodiment, $T_b$ is a temperature at which an elastic modulus of the toner is $1\times10^4$ Pa, and this is used as a criterion of temperature control in first fixing portion 20 and second fixing portion 30. A reason for this will be described below.

For each of a plurality of toner, viscoelasticity measurement was performed under the following measurement conditions, and a relationship between temperature and storage elastic modulus (G') was obtained. In addition, temperature control was performed in first fixing portion 20, and SEM observation of the toner surface was performed for several samples different in maximum temperature $T_{13}$ (° C.) of the surface of recording medium 10 passing through first fixing portion 20. It became clear from the SEM observation that the toner melts and the surface of the toner image becomes uniform and gaps disappear at a temperature equal to or higher than temperature $T_b$ (° C.) at which the elastic modulus of the toner is $1\times10^4$ Pa. Therefore, under the assumption that the surface of the toner image has gaps and the releasing agent in the toner easily seeps out onto the surface of the toner image at a temperature lower than temperature $T_b$, temperature control was performed to satisfy $T_a\leq T_{13}<T_b$, which is a temperature range of equal to or higher than the melting point of the releasing agent and a temperature range in which the releasing agent is in the liquid state and the toner layer has gaps, in order to allow the releasing agent to sufficiently seep out in first fixing portion 20. As a result, the excellent fixation and separation property was obtained. Since the releasing agent having seeped out onto the surface of recording medium 10 in first fixing portion 20 adheres to heating roller 21 in first fixing portion 20, and is conveyed to second fixing portion 30 by recording medium 10 and adheres to heating roller 31 in second fixing portion 30, the releasing agent contributes to the fixation and separation property in first fixing portion 20 and second fixing portion 30. Therefore, the releasing agent contributes to enhancement of the fixation and separation property in fixing device 1 as a whole. In second fixing portion 30, temperature control was performed to satisfy $T_{23}\geq T_b$, and thus, the high fixation strength was obtained.

(Viscoelasticity Measurement of Toner)

A viscoelastic property of the toner was measured by using a viscoelasticity measuring apparatus (rheometer), "RDA-II type" (manufactured by Rheometrics, Inc.).

Measuring jig: A parallel plate having a diameter of 10 mm was used.

Measurement sample: The toner was heated and melted, and then, molded into a cylindrical sample having a diameter of about 10 mm and a height of 1.5 to 2.0 mm, and this cylindrical sample was used.

Setting of measurement strain: An initial value was set at 0.1% and measurement was performed in an automatic measurement mode.

Extension correction of sample: Adjustment was performed in an automatic measurement mode.

Measurement frequency: 6.28 radian per second

Measurement start temperature: 30° C.

Measurement end temperature: 200° C.

Temperature rise condition: 2° C./min

It is preferable that in first fixing portion 20, a temperature $T_{11}$ of heating roller 21 and a temperature $T_{12}$ of pressing roller 22 are adjusted to satisfy $T_{11}>T_{12}$. Such temperature adjustment allows the releasing agent included in the toner to seep out more easily, and thus, the fixation and separation property can be further enhanced.

In first fixing portion 20, the pressure applied to the recording medium is preferably 300 kPa to 1000 kPa. When the pressure is equal to or higher than 300 kPa, the releasing agent can seep out sufficiently. In second fixing portion 30 as well, the pressure applied to the recording medium is preferably 300 kPa to 1000 kPa.

Second Embodiment

Figure 2:
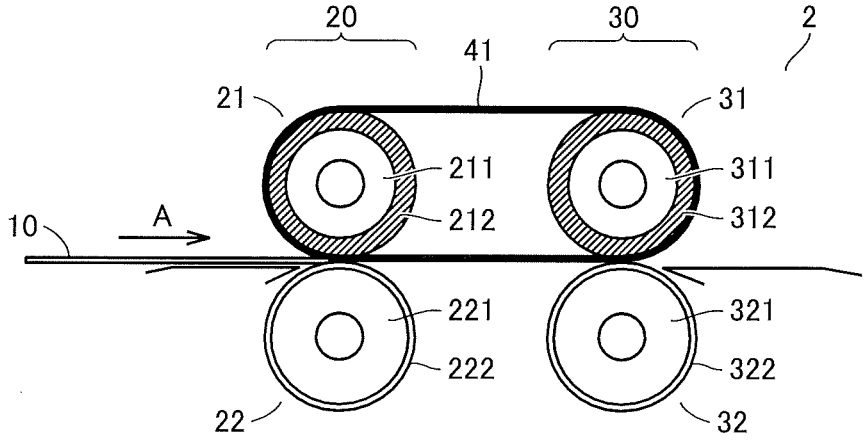
FIG. 2 is a cross-sectional view showing a schematic configuration of a fixing device of a second embodiment.

FIG. 2 is a cross-sectional view showing a schematic configuration of a fixing device of a second embodiment. A fixing device 2 is different from fixing device 1 of the first embodiment shown in FIG. 1, in that fixing device 2 includes an endless belt 41 which is an interposed member that is in contact with heating roller 21 and heating roller 31.

Belt 41 is extended between heating roller 21 and heating roller 31, and follows the rotation of heating roller 21 and heating roller 31. When recording medium 10 is nipped and conveyed by heating roller 21 and pressing roller 22 in first fixing portion 20, belt 41 is interposed between heating roller 21 and recording medium 10 and abuts recording medium 10. Thereafter, with belt 41 abutting recording medium 10, belt 41 moves to second fixing portion 30, and when recording medium 10 is nipped and conveyed by heating roller 31 and pressing roller 32 in second fixing portion 30, belt 41 is interposed between heating roller 31 and recording medium 10.

In fixing device 2 of the present embodiment, in first fixing portion 20, the toner image is pressed and heated such that $T_a \leq T_{13} < T_b$ is satisfied, thereby allowing the releasing agent included in the toner to seep out sufficiently, and thereafter, in second fixing portion 30, the toner image is pressed and heated such that $T_{23} \geq T_b$ is satisfied, thereby allowing the toner image to be fixed sufficiently. Therefore, the excellent fixation and separation property and the high fixation strength can be obtained. Since the releasing agent having seeped out in first fixing portion 20 adheres to the surface of recording medium 10 and belt 41, the releasing agent enhances the separation property between recording medium 10 and belt 41 in second fixing portion 30. In first fixing portion 20 and second fixing portion 30, recording medium 10 is conveyed with common belt 41 being in contact with the surface of recording medium 10. Therefore, when recording medium 10 and belt 41 are separated in second fixing portion 30, the releasing agent having seeped out in first fixing portion 20 contributes to enhancement of the separation property, and thus, the excellent fixation and separation property is obtained.

In fixing device 2, by the not-shown temperature sensor, maximum temperature $T_{13}$ (° C.) of the surface of recording medium 10 passing through first fixing portion 20 and maximum temperature $T_{23}$ (° C.) of the surface of recording medium 10 passing through second fixing portion 30 can be obtained. Although the temperature transition of the surface of the recording medium varies depending on temperature control, the conveyance speed and the like in first fixing portion 20 and second fixing portion 30, the temperature transition normally exhibits temperature rise, arrival at the maximum temperature, and temperature fall in each fixing portion. As the temperature sensor for detecting the surface temperature of the recording medium, a noncontact temperature sensor such as an infrared sensor may, for example, be used. Alternatively, the surface temperature of recording medium 10 may be measured by a fast responsive thermocouple affixed on recording medium 10. When the infrared sensor is used, the infrared sensor may be provided to preliminarily identify a position where the maximum temperature is reached, and detect a temperature at this position. Alternatively, the infrared sensor may be provided to detect temperatures at a plurality of positions and calculate the maximum temperature based on the temperatures detected at these positions. Alternatively, the infrared sensor may be provided to preliminarily detect a temperature at a position where a temperature difference from the maximum temperature is known, and calculate the maximum temperature based on the result of detection at this position.

Third Embodiment

Figure 3:
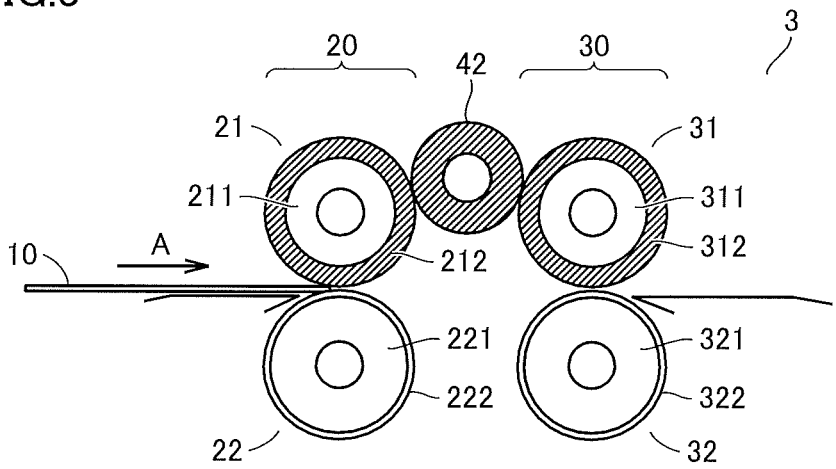
FIG. 3 is a cross-sectional view showing a schematic configuration of a fixing device of a third embodiment.

FIG. 3 is a cross-sectional view showing a schematic configuration of a fixing device of a third embodiment. A fixing device 3 is different from fixing device 1 of the first embodiment shown in FIG. 1, in that fixing device 3 includes a wax conveying roller 42 which is an interposed member that is in contact with heating roller (first fixing member) 21 and heating roller (second fixing member) 31. Wax conveying roller 42 is configured to be moderately pressed in contact with heating roller 21 and heating roller 31, and is provided with a not-shown pressure-applying mechanism and a not-shown pressure adjusting mechanism.

Wax conveying roller 42 is provided between heating roller 21 and heating roller 31 so as to be in contact with both heating roller 21 and heating roller 31. Wax conveying roller 42 may be configured to rotate so as to follow the rotation of heating roller 21 or heating roller 31, or may be configured to rotate by driving. An outermost surface that is in contact with heating rollers 21 and 31 is not particularly limited. However, the outermost surface may, for example, be made of an elastic material such as rubber.

In fixing device 3 of the present embodiment, in first fixing portion 20, the toner image is pressed and heated such that $T_a \leq T_{13} < T_b$ is satisfied, thereby allowing the releasing agent included in the toner to seep out sufficiently, and thereafter, in second fixing portion 30, the toner image is pressed and heated such that $T_{23} \geq T_b$ is satisfied, thereby allowing the toner image to be fixed sufficiently. Therefore, the excellent fixation and separation property and the high fixation strength can be obtained. Since the releasing agent having seeped out in first fixing portion 20 adheres to the surface of recording medium 10 and heating roller 21, the releasing agent contributes to enhancement of the separation property between recording medium 10 and heating roller 21 in first fixing portion 20. Wax conveying roller 42 conveys the releasing agent having adhered to heating roller 21 and causes the releasing agent to adhere to heating roller 31. Therefore, the releasing agent conveyed by recording medium 10 and the releasing agent conveyed by wax conveying roller 42 adhere to heating roller 31 of second fixing portion 30, and the releasing agent contributes to enhancement of the separation property between recording medium 10 and heating roller 31. Accordingly, the excellent fixation and separation property is obtained in second fixing portion 30.

In fixing device 3, by the not-shown temperature sensor, maximum temperature $T_{13}$ (° C.) of the surface of recording medium 10 passing through first fixing portion 20 and maximum temperature $T_{23}$ (° C.) of the surface of recording medium 10 passing through second fixing portion 30 can be obtained. Although the temperature transition of the surface of the recording medium varies depending on temperature control, the conveyance speed and the like in first fixing portion 20 and second fixing portion 30, the temperature transition normally exhibits temperature rise, arrival at the maximum temperature, and temperature fall in each fixing portion. As the temperature sensor for detecting the surface temperature of the recording medium, a noncontact temperature sensor such as an infrared sensor may, for example, be used. Alternatively, the surface temperature of recording medium 10 may be measured by a fast responsive thermocouple affixed on recording medium 10. When the infrared sensor is used, the infrared sensor may be provided to preliminarily identify a position where the maximum temperature is reached, and detect a temperature at this position. Alternatively, the infrared sensor may be provided to detect temperatures at a plurality of positions and calculate the maximum temperature based on the temperatures detected at these positions. Alternatively, the infrared sensor may be provided to preliminarily detect a temperature at a position where a temperature difference from the maximum temperature is known, and calculate the maximum temperature based on the result of detection at this position.

Fourth Embodiment

Figure 4:
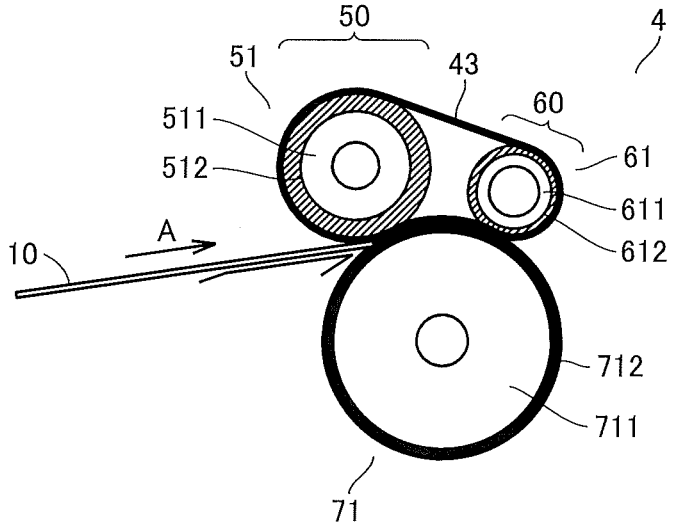
FIG. 4 is a cross-sectional view showing a schematic configuration of a fixing device of a fourth embodiment.

FIG. 4 is a cross-sectional view showing a schematic configuration of a fixing device of a fourth embodiment. A fixing device 4 includes a first fixing portion 50 and a second fixing portion 60 in this order along conveyance direction A of recording medium 10. In first fixing portion 50, a heating roller (first fixing member) 51 and a pressing roller (first pressing member) 71 are arranged to face each other. In second fixing portion 60, a heating roller (second fixing member) 61 and pressing roller (second pressing member) 71 are arranged to face each other. Fixing device 4 also includes an endless belt 43 extended between heating roller 51 and heating roller 61.

Fixing device 4 is different from fixing device 1 of the first embodiment shown in FIG. 1, in that one pressing roller 71 is commonly used as the first pressing member and the second pressing member, and in that fixing device 4 includes endless belt 43 which is an interposed member that is in contact with first fixing member 51 and second fixing member 61.

Belt 43 follows the rotation of heating roller 51 and heating roller 61. When recording medium 10 is nipped and conveyed by heating roller 51 and pressing roller 71 in first fixing portion 50, belt 43 is interposed between heating roller 51 and recording medium 10 and abuts recording medium 10. Thereafter, with belt 43 and pressing roller 71 abutting recording medium 10, belt 43 moves to second fixing portion 60, and recording medium 10 is nipped and conveyed by heating roller 61 and pressing roller 71 in second fixing portion 60. At this time, belt 43 is interposed between heating roller 61 and recording medium 10 and abuts recording medium 10.

Heating roller 51, 61 includes a cylindrical base member 511, 611 made of metal, and a rubber layer 512, 612 formed on a surface thereof. A releasing layer is formed on a surface of rubber layer 512, 612. A heating member (not shown) for heating cylindrical base member 511, 611 is provided inside cylindrical base member 511, 611. The heating member is a glass tube heater having a filament and heats the whole of heating roller 51, 61 by radiating heat rays from inside cylindrical base member 511, 611. The temperature of heating roller 51, 61 is monitored by a temperature sensor (not shown) placed on a surface thereof and is fed back to a temperature control circuit, so that heating roller 51, 61 is controlled to a prescribed temperature.

A heat-resistant rubber material is used for rubber layer 512, 612 of the heating roller, and silicone rubber, acrylic rubber, fluorine rubber or the like is used. The thickness is preferably in the range of 5 to 50 mm, and a value of the hardness is preferably in the range of 5 to 60 in accordance with JIS K6253. A fluorine-based film having excellent heat resistance and releasing property is suitable as the releasing layer. Fluorine resin such as PTFE, or copolymer resin such as PFA is suitable as a material of the fluorine-based film.

Pressing roller 71 includes a cylindrical base member 711 made of metal, and a rubber layer 712 formed on a surface thereof. A heating member (not shown) for heating cylindrical base member 711 is provided inside cylindrical base member 711. The heating member is a glass tube heater having a filament and heats the whole of pressing roller 71 by radiating heat rays from inside cylindrical base member 711. The temperature of pressing roller 71 is monitored by a temperature sensor (not shown) placed on a surface thereof and is fed back to a temperature control circuit, so that pressing roller 71 is controlled to a prescribed temperature.

A heat-resistant rubber material is used for rubber layer 712 of the pressing roller, and silicone rubber, acrylic rubber, fluorine rubber or the like is used. The thickness is preferably in the range of 0.5 to 30 mm, and a value of the hardness is preferably in the range of 5 to 60 in accordance with JIS K6253.

In fixing device 4 of the present embodiment, in first fixing portion 50, the toner image is pressed and heated such that $T_a \leq T_{13} < T_b$ is satisfied, thereby allowing the releasing agent included in the toner to seep out sufficiently, and thereafter, in second fixing portion 60, the toner image is pressed and heated such that $T_{23} \geq T_b$ is satisfied, thereby allowing the toner image to be fixed sufficiently. Therefore, the excellent fixation and separation property and the high fixation strength can be obtained. Since the releasing agent having seeped out in first fixing portion 50 adheres to the surface of recording medium 10 and belt 43, the releasing agent enhances the separation property between recording medium 10 and belt 43 in second fixing portion 60. In first fixing portion 50 and second fixing portion 60, recording medium 10 is conveyed with common belt 43 being in contact with the surface of recording medium 10. Therefore, when recording medium 10 and belt 43 are separated in second fixing portion 60, the releasing agent having seeped out in first fixing portion 50 contributes to enhancement of the separation property, and thus, the excellent fixation and separation property is obtained.

In fixing device 4, by the not-shown temperature sensor, maximum temperature $T_{13}$ (° C.) of the surface of recording medium 10 passing through first fixing portion 50 and maximum temperature $T_{23}$ (° C.) of the surface of recording medium 10 passing through second fixing portion 60 can be obtained. Although the temperature transition of the surface of the recording medium varies depending on temperature control, the conveyance speed and the like in first fixing portion 50 and second fixing portion 60, the temperature transition normally exhibits temperature rise, arrival at the maximum temperature, and temperature fall in each fixing portion. As the temperature sensor for detecting the surface temperature of the recording medium, a noncontact temperature sensor such as an infrared sensor may, for example, be used. Alternatively, the surface temperature of recording medium 10 may be measured by a fast responsive thermocouple affixed on recording medium 10. When the infrared sensor is used, the infrared sensor may be provided to preliminarily identify a position where the maximum temperature is reached, and detect a temperature at this position. Alternatively, the infrared sensor may be provided to detect temperatures at a plurality of positions and calculate the maximum temperature based on the temperatures detected at these positions. Alternatively, the infrared sensor may be provided to preliminarily detect a temperature at a position where a temperature difference from the maximum temperature is known, and calculate the maximum temperature based on the result of detection at this position.

Fifth Embodiment

Figure 5:
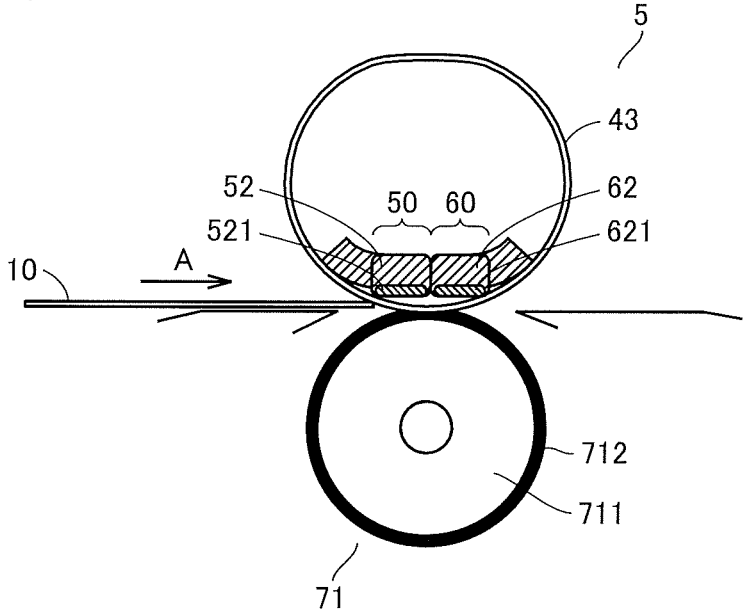
FIG. 5 is a cross-sectional view showing a schematic configuration of a fixing device of a fifth embodiment.

FIG. 5 is a cross-sectional view showing a schematic configuration of a fixing device of a fifth embodiment. A fixing device 5 includes first fixing portion 50 and second fixing portion 60 in this order along conveyance direction A of recording medium 10. Fixing device 5 is different from fixing device 4 of the fourth embodiment, in that a heating pad 52 is arranged as the first fixing member instead of heating roller 51 and a heating pad 62 is arranged as the second fixing member instead of heating roller 61, and in that endless belt 43 is configured to be pivotable by driving. Belt 43 pivots while maintaining the contact with heating pads 52 and 62.

Near a surface of heating pad 52, 62 that is in contact with belt 43, heating pad 52, 62 includes a heated portion 521, 621 made of metal. A heating member (not shown) for heating heated portion 521, 621 is provided inside heated portion 521, 621. The heating member is a glass tube heater having a filament and heats the whole of heated portion 521, 621 by radiating heat rays from inside heated portion 521, 621. Heating pad 52, 62 is formed of an elastic body and can press and heat recording medium 10 in combination with pressing roller 71.

In first fixing portion 50, recording medium 10 is nipped and conveyed by belt 43 and pressing roller 71. At this time, recording medium 10 is pressed and heated by heating pad 52. In second fixing portion 60, recording medium 10 is nipped and conveyed by belt 43 and pressing roller 71. At this time, recording medium 10 is pressed and heated by heating pad 62.

In fixing device 5 of the present embodiment, in first fixing portion 50, the toner image is pressed and heated such that $T_a \leq T_{13} < T_b$ is satisfied, thereby allowing the releasing agent included in the toner to seep out sufficiently, and thereafter, in second fixing portion 60, the toner image is pressed and heated such that $T_{23} \geq T_b$ is satisfied, thereby allowing the toner image to be fixed sufficiently. Therefore, the excellent fixation and separation property and the high fixation strength can be obtained. Since the releasing agent having seeped out in first fixing portion 50 adheres to the surface of recording medium 10 and belt 43, the releasing agent enhances the separation property between recording medium 10 and belt 43 in second fixing portion 60. In first fixing portion 50 and second fixing portion 60, recording medium 10 is conveyed with common belt 43 being in contact with the surface of recording medium 10. Therefore, when recording medium 10 and belt 43 are separated in second fixing portion 60, the releasing agent having seeped out in first fixing portion 50 contributes to enhancement of the separation property, and thus, the excellent fixation and separation property is obtained.

In fixing device 5, by the not-shown temperature sensor, maximum temperature $T_{13}$ (° C.) of the surface of recording medium 10 passing through first fixing portion 50 and maximum temperature $T_{23}$ (° C.) of the surface of recording medium 10 passing through second fixing portion 60 can be obtained. Although the temperature transition of the surface of the recording medium varies depending on temperature control, the conveyance speed and the like in first fixing portion 50 and second fixing portion 60, the temperature transition normally exhibits temperature rise, arrival at the maximum temperature, and temperature fall in each fixing portion. As the temperature sensor for detecting the surface temperature of the recording medium, a noncontact temperature sensor such as an infrared sensor may, for example, be used. Alternatively, the surface temperature of recording medium 10 may be measured by a fast responsive thermocouple affixed on recording medium 10. When the infrared sensor is used, the infrared sensor may be provided to preliminarily identify a position where the maximum temperature is reached, and detect a temperature at this position. Alternatively, the infrared sensor may be provided to detect temperatures at a plurality of positions and calculate the maximum temperature based on the temperatures detected at these positions. Alternatively, the infrared sensor may be provided to preliminarily detect a temperature at a position where a temperature difference from the maximum temperature is known, and calculate the maximum temperature based on the result of detection at this position.

[Fixing Method]

A fixing method of the present embodiment is a fixing method for fixing a toner image formed on a recording medium by toner. Used as the toner that forms the toner image is toner including a releasing agent and satisfying $T_a < T_b$, where $T_a$ (° C.) represents a melting point of the releasing agent and $T_b$ (° C.) represents a temperature at which an elastic modulus of the toner is $1 \times 10^4$ Pa. In the fixing method of the present embodiment, the recording medium is conveyed in the order of a first fixing step and a second fixing step, so that the toner image is fixed on a surface of the recording medium. In the first fixing step, the toner image is pressed and heated such that a maximum temperature $T_{13}$ (° C.) of the surface of the recording medium satisfies $T_a \leq T_{13} < T_b$, and in the second fixing step, the toner image is pressed and heated such that a maximum temperature $T_{23}$ (° C.) of the surface of the recording medium satisfies $T_{23} \geq T_b$. The fixing device described above can be used as a fixing device for achieving the fixing method of the present embodiment.

[Image Forming Apparatus]

Figure 6:
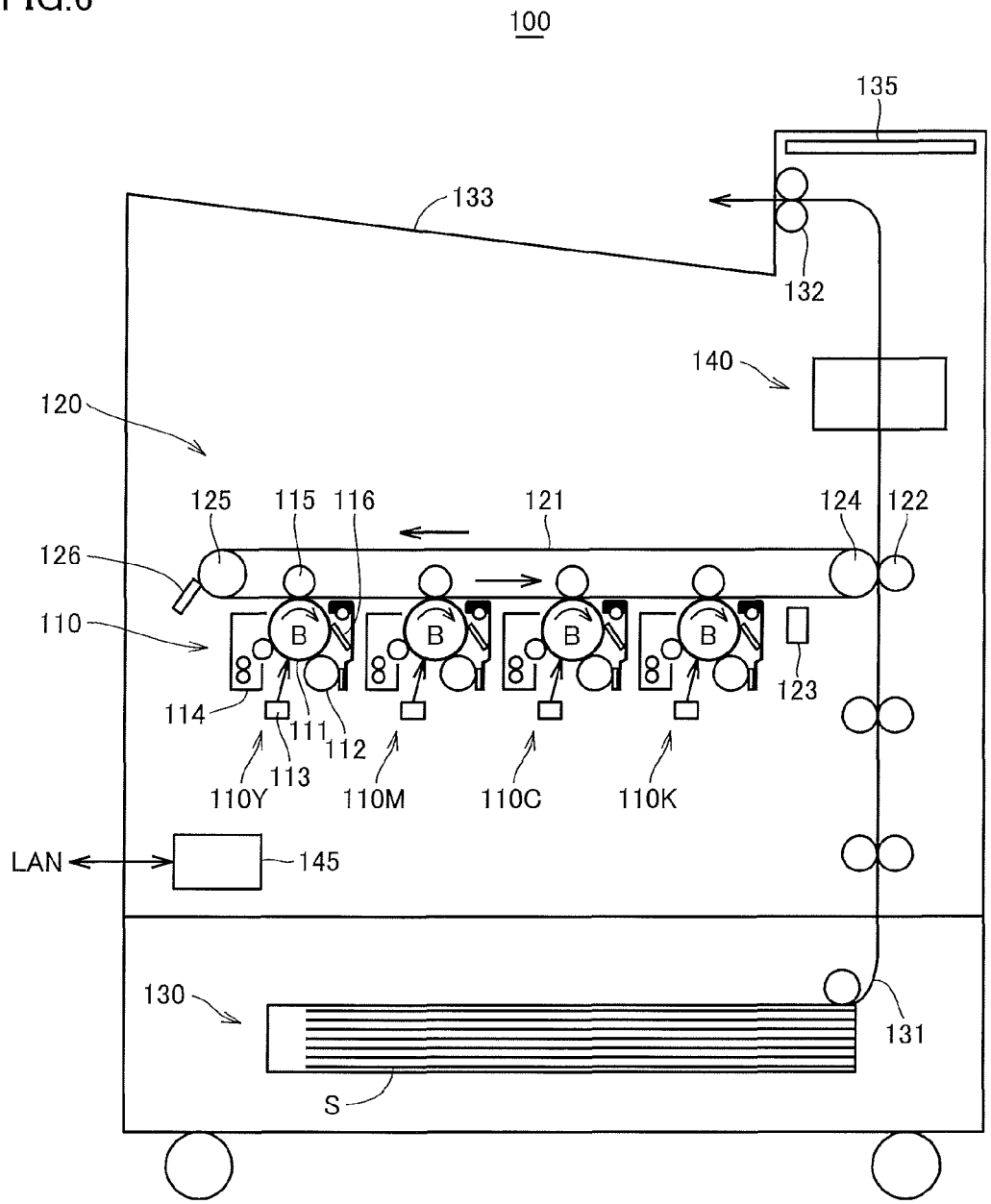
FIG. 6 is a cross-sectional view showing a schematic configuration of an image forming apparatus of the present embodiment.

An image forming apparatus of the present embodiment is an apparatus including any one of the fixing devices described above, and as long as the image forming apparatus of the present embodiment includes such fixing device, a conventionally known configuration can be used as the remaining configuration without particular limitation. The image forming apparatus of the present embodiment will be described below with reference to FIG. 6. FIG. 6 is a cross-sectional view showing a schematic configuration of one example of the image forming apparatus of the present embodiment.

An image forming apparatus 100 in FIG. 6 is an apparatus for forming an image on a recording material by using a known electrophotographic method. Image forming apparatus 100 includes an image processing unit 110, a transferring unit 120, a paper feeding unit 130, a fixing unit 140, and a control unit 145, and selectively performs color printing and monochromatic printing based on a print job received from an external terminal device (not shown) via a network (e.g., LAN).

Image processing unit 110 has imaging units 110Y to 110K corresponding to developing colors of yellow (Y), magenta (M), cyan (C), and black (K). Imaging unit 110Y includes an electrophotographic photoreceptor 111 which is an electrostatic latent image carrier, a charger 112 disposed therearound, an exposing unit 113, a developing unit 114, a primary transfer roller 115, a cleaner 116 and the like. Charger 112 provides charges to a circumferential surface of electrophotographic photoreceptor 111 rotating in the direction shown by an arrow B.

Exposing unit 113 performs exposing and scanning of charged electrophotographic photoreceptor 111 by laser light to form an electrostatic latent image on electrophotographic photoreceptor 111. A developer including toner is housed in developing unit 114, and developing unit 114 develops the electrostatic latent image on electrophotographic photoreceptor 111 by the toner, so that a toner image of Y color is formed on electrophotographic photoreceptor 111. Namely, the toner image is carried by the electrostatic latent image carrier.

Primary transfer roller 115 transfers the toner image of Y color on electrophotographic photoreceptor 111 onto an intermediate transfer member 121 by the electrostatic action. Namely, the aforementioned toner image is primary-transferred onto the intermediate transfer member. Cleaner 116 cleans the remaining toner remaining on electrophotographic photoreceptor 111 after transfer. According to the electrophotographic photoreceptor of the present embodiment, the excellent cleaning property is obtained as described above, and this means that removability of the remaining toner remaining on electrophotographic photoreceptor 111 by cleaner 116 is excellent.

Other imaging units 110M to 110K have a configuration similar to that of imaging unit 110Y, and thus, the reference characters are not given in FIG. 6. Transferring unit 120 includes intermediate transfer member 121 extended between a driving roller 124 and a driven roller 125 and circulating and running in the arrow direction. This intermediate transfer member 121 has a seamless belt shape (i.e., an endless belt-like shape) and has a cylindrical shape obtained by injection molding or centrifugal molding of a resin material to have a desired perimeter determined depending on design.

When color printing (color mode) is performed, a toner image of a corresponding color is formed on electrophotographic photoreceptor 111 and each formed toner image is transferred onto intermediate transfer member 121, in each of imaging units 110M to 110K. These imaging operations in Y to K colors are performed in accordance with timing shifted from the upstream side to the downstream side, such that the toner images of the respective colors are overlapped at the same position of running intermediate transfer member 121 and transferred.

In time with the aforementioned imaging timing, paper feeding unit 130 lets out a sheet S which is a recording material from a paper feeding cassette one by one, and conveys let-out sheet S to a secondary transfer roller 122 along a conveyance path 131. When sheet S conveyed to secondary transfer roller 122 passes through between secondary transfer roller 122 and intermediate transfer member 121, the toner images of the respective colors formed on intermediate transfer member 121 are secondary-transferred onto sheet S at one time by the electrostatic action of secondary transfer roller 122. Namely, the toner images are secondary-transferred from the intermediate transfer member to the recording material.

Sheet S having the toner images of the respective colors secondary-transferred thereonto is conveyed to fixing unit 140, and is heated and pressed in fixing unit 140, so that the toner on a surface of sheet S is fused and fixed onto the surface of sheet S. Thereafter, sheet S is ejected onto a paper ejection tray 133 by a paper ejection roller 132. In this manner, an image corresponding to the toner images is formed on the recording material. In fixing unit 140, the fixing device described above is used.

In the foregoing description, the operation when the color mode is performed has been described. When monochromatic, e.g., black-color printing (monochromatic mode) is performed, only imaging unit 110K for black color is driven, and the steps of charging, exposing, developing, transferring, and fixing for black color are performed in accordance with the operation similar to the operation described above, so that an image of black color is formed (printed) on recording sheet S.

The toner or the toner pattern on intermediate transfer member 121 that has not been transferred onto recording sheet S is removed by a cleaning blade 126 disposed at a position facing driven roller 125 with intermediate transfer member 121 interposed therebetween. In addition, a concentration detecting sensor 123 formed of a reflective photoelectric sensor is, for example, disposed on the downstream side of imaging unit 110K in the running direction of intermediate transfer member 121. Concentration detecting sensor 123 detects a concentration of the toner pattern formed on intermediate transfer member 121.

Based on the data of the print job received from the external terminal device via the network, control unit 145 controls each unit and allows execution of the smooth printing operation. An operation panel 135 is arranged at a position on the front and upper side of the main body of image forming apparatus 100 where the user can easily operate operation panel 135. Operation panel 135 includes a button, a touch panel-type liquid crystal display portion or the like for receiving various types of instructions from the user, and can transmit the received instructions to control unit 145.

Examples of the image forming apparatus described above can include an electrophotographic image forming apparatus such as a copier, a printer, a digital printer, and a simplified printer.

[Toner]

The toner used to form the toner image on the surface of the recording medium in the fixing device and the image forming apparatus described above is not particularly limited, as long as the toner is at least toner including a binder resin and a releasing agent and satisfying a relationship of $T_a<T_b$, where $T_a$ (° C.) represents a melting point of the releasing agent and $T_b$ (° C.) represents a temperature at which an elastic modulus of the toner is $1\times10^4$ Pa.

(Binder Resin)

The binder resin that forms the toner is not particularly limited, and various types of known binder resins can be used. Examples of the binder resin include styrene resin, acrylic resin, styrene-acrylic resin, polyester resin, silicone resin, olefin resin, amide resin, epoxy resin or the like. From the perspective of the toner particle size, the shape controllability and the chargeability, it is preferable that the binder resin includes styrene-acrylic resin. A styrene-based monomer such as styrene, methylstyrene, methoxystyrene, butylstyrene, phenylstyrene, and chlorostyrene; a (meta)acrylate ester-based monomer such as methyl(meta)acrylate, ethyl (meta)acrylate, butyl(meta)acrylate, and ethylhexyl(meta) acrylate; a carboxylic acid-based monomer such as acrylic acid, methacrylic acid and fumaric acid; or the like can, for example, be used as a polymerizable monomer for obtaining styrene-acrylic resin. One type or two or more types of these monomers can be combined and used. A glass transition point (Tg) of the binder resin is preferably 30 to 50° C., and more preferably 35 to 48° C. When the glass transition point of the binder resin is in the aforementioned range, the low-temperature fixation property and the heat-resistant storability are both obtained.

The glass transition point of the binder resin is measured by using "Diamond DSC" (manufactured by Perkin-Elmer Corp.). As a measurement procedure, 3.0 mg of a sample (binder resin) is put into an aluminum pan and this is set in a holder. An empty aluminum pan is used as a reference. Heat-cool-Heat temperature control is performed under the measurement conditions of the measurement temperature being 0° C. to 200° C., the temperature rise speed being 10° C./min, and the temperature fall speed being 10° C./min, and analysis is performed based on the data in the second Heat. An extended line of a baseline before rising of a first endothermic peak and a tangent line showing a maximum slope between the rising portion of the first peak and the peak top are drawn, and an intersection of these lines is defined as the glass transition point.

(Releasing Agent)

The known wax can be used as the releasing agent included in the toner. Examples of the known wax include: polyolefin wax such as polyethylene wax and polypropylene wax; branched-chain hydrocarbon wax such as microcrystalline wax; long-chain hydrocarbon-based wax such as paraffin wax and xazole wax; dialkyl ketone-based wax such as distearyl ketone; carnauba wax; montan wax; ester-based wax such as behenic acid behenate, trimethylolpropane tribehenate, pentaerythritol tetrabehenate, pentaerythritol diacetate dibehenate, glycerin tribehenate, 1,18-octadecanediol distearate, trimellitic acid tristearyl, and distearyl maleate; amide-based wax such as ethylenediamine behenyl amide and trimellitic acid tristearyl amide; and the like. Among these, branched-chain hydrocarbon wax such as microcrystalline wax is particularly preferable from the perspective of suppressing uneven luster.

The melting point of the releasing agent included in the toner is preferably 70 to 100° C., and more preferably 70 to 85° C. The melting point of the releasing agent shows a peak top temperature of an endothermic peak and is DSC-measured in accordance with differential scanning calorimetric analysis by using a differential scanning calorimeter, "DSC-7" (manufactured by Perkin-Elmer Corp.) and a thermal analysis device controller, "TACT/DX" (manufactured by Perkin-Elmer Corp.).

Specifically, 4.5 mg of a sample (releasing agent) is put into an aluminum pan (KIT NO. 0219-0041) and this is set in a sample holder of "DSC-7". Then, Heat-cool-Heat temperature control is performed under the measurement conditions of the measurement temperature being 0 to 200° C., the temperature rise speed being 10° C./min, and the temperature fall speed being 10° C./min, and analysis is performed based on the data in the second Heat. An empty aluminum pan is used for measurement of a reference.

A content of the releasing agent is preferably 1 to 30 parts by mass, and more preferably 5 to 20 parts by mass, with respect to 100 parts by mass of the binder resin. When the content rate of the wax is in the aforementioned range, the excellent fixation and separation property is obtained.

(Colorant)

When a colorant is included in the toner, a generally-known dye and pigment can be used as the colorant. Various types of known colorants such as a magnetic material including carbon black such as furnace black and channel black, magnetite, and ferrite; a dye; and an inorganic pigment including non-magnetic iron oxide can be arbitrarily used as a colorant for obtaining the toner of black color.

A known colorant such as a dye and an organic pigment can be arbitrarily used as a colorant for obtaining the color toner. Specifically, examples of the organic pigment can include C.I. Pigment Red 5, C.I. Pigment Red 48:1, C.I. Pigment Red 53:1, C.I. Pigment Red 57:1, C.I. Pigment Red 81:4, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, C.I. Pigment Red 238, C.I. Pigment Red 269, C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, C.I. Pigment Yellow 185, C.I. Pigment Orange 31, C.I. Pigment Orange 43, C.I. Pigment Blue 15:3, C.I. Pigment Blue 60, C.I. Pigment Blue 76 and the like. Examples of the dye can include C.I. Solvent Red 1, C.I. Solvent Red 49, C.I. Solvent Red 52, C.I. Solvent Red 58, C.I. Solvent Red 68, C.I. Solvent Red 11, C.I. Solvent Red 122, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 69, C.I. Solvent Blue 70, C.I. Solvent Blue 93, C.I. Solvent Blue 95 and the like.

As the colorant for obtaining the toner of each color, one type of colorant can be used alone or two or more types of colorants can be combined and used for each color. A content rate of the colorant is preferably 1 to 10 parts by mass, and more preferably 2 to 8 parts by mass, with respect to 100 parts by mass of the binder resin.

(Charge Control Agent)

When a charge control agent is included in the toner, a known positive charge control agent or negative charge control agent can be used. Specifically, examples of the positive charge control agent include: a nigrosine-based dye such as "Nigrosine Base EX" (manufactured by Orient Chemical Industries Co., Ltd.); a quaternary ammonium salt such as "Quaternary Ammonium Salt P-51" (manufactured by Orient Chemical Industries Co., Ltd.) and "COPY CHARGE PX VP435" (manufactured by Hoechst Japan Co., Ltd.); alkoxylated amine; alkylamide; a molybdate chelate pigment; and an imidazole compound such as "PLZ1001" (manufactured by Shikoku Chemicals Corp.); and the like.

Examples of the negative charge control agent include: a metal complex such as "BONTRON S-22" (manufactured by Orient Chemical Industries Co., Ltd.), "BONTRON S-34" (manufactured by Orient Chemical Industries Co., Ltd.), "BONTRON E-81" (manufactured by Orient Chemical Industries Co., Ltd.), "BONTRON E-84" (manufactured by Orient Chemical Industries Co., Ltd.), and "Spilon Black TRH" (manufactured by Hodogaya Chemical Co., Ltd.); a thioindigo-based pigment; a quaternary ammonium salt such as "COPY CHARGE NX VP434" (manufactured by Hoechst Japan Co., Ltd.); a calixarene compound such as "BONTRON E-89" (manufactured by Orient Chemical Industries Co., Ltd.); a boron compound such as "LR147" (manufactured by Japan Carlit Co., Ltd.); a fluorine compound such as magnesium fluoride and carbon fluoride; and the like. In addition to the aforementioned metal complexes, examples of the metal complex used as the negative charge control agent include metal complexes having various types of structures such as an oxycarboxylic acid metal complex, a dicarboxylic acid metal complex, an amino acid metal complex, a diketone metal complex, a diamine metal complex, an azo group-containing benzene-benzene derivative backbone metal complex, and azo group-containing benzene-naphthalene derivative backbone metal complex.

A content of the charge control agent is preferably 0.01 to 30 parts by mass, and more preferably 0.1 to 10 parts by mass, with respect to 100 parts by mass of the binder resin.

(External Additive)

The toner can be used as it is. However, an external additive may be added in order to improve the fluidity, the chargeability, the cleaning property and the like. Examples of the external additive include inorganic fine particles including: inorganic oxide fine particles such as silica fine particles, alumina fine particles and titanium oxide fine particles; inorganic stearic acid compound fine particles such as aluminum stearate fine particles and zinc stearate fine particles; inorganic titanium acid compound fine particles such as strontium titanate and zinc titanate; and the like. From the perspective of the heat-resistant storability and the environmental stability, it is preferable that these inorganic fine particles are subjected to surface-treatment with a silane coupling agent, a titanium coupling agent, a higher fatty acid, a silicone oil or the like.

An average primary particle size of the inorganic fine particles forming the external additive is preferably equal to or smaller than 30 nm. When the external additive formed of the inorganic fine particles has the aforementioned particle size, liberation of the external additive is less likely to occur in the toner during image formation. An amount of addition of the external additive to the toner is 0.05 to 5 mass %, and preferably 0.1 to 3 mass %.

(Developer)

The toner can be used as a magnetic or non-magnetic monocomponent developer. However, the toner may be mixed with a carrier and used as a two-component developer. When the toner is used as the two-component developer, magnetic particles made of a conventionally known material including: ferromagnetic metal such as iron; an alloy of ferromagnetic metal and aluminum, lead or the like; a ferromagnetic metal compound such as ferrite and magnetite; and the like can be used as the carrier, and ferrite particles are particularly preferable. A coated carrier obtained by coating a surface of magnetic particles with a coating agent such as resin, a binder-type carrier having magnetic material fine particles dispersed in a binder resin, or other carriers can also be used as the carrier. The coating resin that forms the coated carrier is not particularly limited. However, examples of the coating resin include olefin-based resin, styrene-based resin, styrene-acrylic resin, silicone-based resin, ester resin, fluorine resin and the like. The resin that forms the resin dispersion-type carrier is not particularly limited and a known resin can be used. For example, styrene-acrylic resin, polyester resin, fluorine resin, phenol resin or the like can be used.

When the toner is used as the two-component developer, the two-component developer can also be formed by further adding a charge control agent, an adhesion enhancer, a primer treatment agent, a resistance control agent or the like to the toner and the carrier as necessary.

(Average Particle Size of Toner Particles)

The toner particles have an average particle size of preferably 3 to 9 μm, and more preferably 3 to 8 μm, based on a volume-based median diameter, for example. When the toner is manufactured by using, for example, an emulsification flocculation method described below, this particle size can be controlled in accordance with a concentration of a used flocculant, an amount of addition of an organic solvent, the fusing time, and a composition of a polymer.

When the volume-based median diameter is in the aforementioned range, the transfer efficiency is enhanced, and the halftone image quality is enhanced, and the image quality of a thin line, a dot and the like is enhanced. The volume-based median diameter of the toner particles is measured and calculated by using a measuring apparatus having a computer system connected thereto, and this computer system is configured by installing data processing software, "Software V3. 51" on "Multisizer 3" (manufactured by Beckman Coulter, Inc.). Specifically, 0.02 g of a sample (toner particles) is added to and blended with 20 mL of a surfactant solution (surfactant solution obtained by, for example, tenfold diluting a neutral detergent including a surfactant component with pure water in order to disperse the toner particles), and then, ultrasonic dispersion is performed for one minute to prepare a toner particle dispersion liquid. Then, by using a pipette, this toner particle dispersion liquid is injected into a beaker containing "ISOTON II" (manufactured by Beckman Coulter, Inc.) within a sample stand, until a display concentration of the measuring apparatus reaches 8%. This concentration range allows obtainment of a reproducible measurement value. Then, in the measuring apparatus, the number of counts of measured particles is set at 25000 and an aperture diameter is set at 50 μm and the range of 1 to 30 μm which is a measurement range is divided into 256 parts to calculate a frequency value. The particle size falling within 50% from the highest volume cumulative fraction is defined as the volume-based median diameter.

(Average Circularity of Toner Particles)

From the perspective of enhancing the transfer efficiency, an average circularity of the toner particles is preferably 0.930 to 1.000, and more preferably 0.950 to 0.995. The average circularity of the toner particles is measured by using "FPIA-2100" (manufactured by Sysmex Corp.). Specifically, a sample (toner particles) is blended with a surfactant-containing aqueous solution, and the ultrasonic dispersion treatment is performed for one minute to disperse the toner particles. Thereafter, by using "FPIA-2100" (manufactured by Sysmex Corp.), a picture is taken under the measurement condition of an HPF (high-power imaging) mode, at such a proper concentration that the number of HPF detection is 3000 to 10000. Then, a circularity of each toner particle is calculated in accordance with the following equation (T):

circularity=(a perimeter of a circle having the same projected area as that of a particle image)/(a perimeter of the projected particle image).

Then, the circularities of the toner particles are added and the result of addition is divided by the number of all toner particles. The average circularity of the toner particles is thus calculated.

(Storage Elastic Modulus of Toner)

From the perspective of the luster level stability and the high-temperature offset resistance, a storage elastic modulus (G' 170) of the toner at a temperature of 170° C. is preferably $1\times10^2$ to $1\times10^3$ (Pa). If the value of G' 170 is smaller than $1\times10^2$ Pa, a change in luster level caused by temperature change is sharp, and the luster level is likely to change at a leading end and a rear end of an image, and thus, a stable image is not obtained and high-temperature offset is likely to occur. If the value of G' 170 is larger than $1\times10^3$ Pa, the toner is not sufficiently dissolved and the luster level becomes insufficient. The storage elastic modulus (G' 170) of the toner is set at a value based on the result of viscoelasticity measurement described above.

(Softening Point of Toner)

A softening point (Tsp) of the toner is preferably 90 to 110° C. When the softening point (Tsp) is in the aforementioned range, image formation can be performed without any burden on the colorant, and thus, development of wider and more stable color reproducibility is expected. The softening point (Tsp) of the toner can be controlled, for example, by using any one of the following methods alone or by combining the following methods:

(1) adjusting a type and/or a composition ratio of the polymerizable monomer that should form the binder resin;

(2) adjusting a molecular weight of the binder resin in accordance with a type and/or an amount of addition of a chain transfer agent; and (3) adjusting a type and/or an amount of addition of the releasing agent and the like.

The softening point (Tsp) of the toner is measured by the following method. Specifically, by using "Flow Tester CFT-500" (manufactured by Shimadzu Corp.), the toner is formed into a cylindrical shape having a height of 10 mm, and the pressure of $1.96\times10^6$ Pa is applied by a plunger while heating the toner at a temperature rise speed of 6° C./min, and the toner is extruded from a nozzle having a diameter of 1 mm and a length of 1 mm. Thus, a curve (softening and fluidizing curve) showing a relationship between the plunger fall amount of the flow tester and the temperature is drawn, and a temperature at the time of first outflow is defined as a melting start temperature, and a temperature corresponding to the fall amount of 5 mm is defined as a softening point temperature.

[Method for Manufacturing Toner]

Examples of a method for manufacturing the toner can include a kneading and pulverizing method, an emulsification dispersion method, a suspension polymerization method, a dispersion polymerization method, an emulsification polymerization method, an emulsification polymerization flocculation method, a miniemulsion polymerization flocculation method, an encapsulation method, and other known methods. However, considering that it is necessary to obtain the toner having a small particle size in order to achieve the higher image quality, it is preferable to use the emulsification polymerization flocculation method, from the perspective of the manufacturing cost and the manufacturing stability. The emulsification polymerization flocculation method is a method for manufacturing the toner by mixing a dispersion liquid of fine particles formed of a binder resin (hereinafter also referred to as "binder resin fine particles"), which are manufactured by the emulsification polymerization method, with a dispersion liquid of fine particles formed of a colorant (hereinafter also referred to as "colorant fine particles"), and slowly flocculating the fine particles while maintaining a balance between the repulsion force on the fine particle surface by pH adjustment and the flocculation force by addition of a flocculant formed of an electrolyte, and associating the fine particles while controlling an average particle size and a particle size distribution, and at the same time, heating and stirring the fine particles to fuse the fine particles and perform shape control.

In the method for manufacturing the toner, the binder resin fine particles formed in the case of using the emulsification polymerization flocculation method can also be configured to have two or more layers formed of binder resins having different compositions. In this case, a method for adding a polymerization initiator and a polymerizable monomer to a dispersion liquid of the first binder resin fine particles prepared by the emulsification polymerization treatment (first stage polymerization) in accordance with the ordinary method, and performing the polymerization treatment (second stage polymerization) of this system can be used.

The toner may be configured to have a core-shell structure, and a method for manufacturing this toner having the core-shell structure can be obtained by associating, flocculating and fusing binder resin fine particles for core and colorant fine particles to fabricate core particles, and then, adding binder resin fine particles for shell for forming a shell layer to a dispersion liquid of the core particles, and flocculating and fusing these binder resin fine particles for shell onto the core particle surface to form the shell layer covering the core particle surface.

The method for manufacturing the toner having the core-shell structure will be specifically described below. The method for manufacturing the toner having the core-shell structure includes:

(1) a colorant fine particle dispersion liquid preparing step of preparing a dispersion liquid of colorant fine particles in which a colorant is dispersed in the form of fine particles;

(2-1) a binder-resin-fine-particles-for-core polymerizing step of obtaining binder resin fine particles for core formed of a binder resin for core and including a primary wax and an internal additive, and preparing a dispersion liquid of the binder resin fine particles for core;

(2-2) a binder-resin-fine-particles-for-shell polymerizing step of obtaining binder resin fine particles for shell formed of a binder resin for shell, and preparing a dispersion liquid of the binder resin fine particles for shell;

(3) a flocculating and fusing step of flocculating and fusing the binder resin fine particles for core and the colorant fine particles in a water-based medium to obtain associated particles that should form core particles;

(4) a first maturing step of maturing the associated particles by thermal energy to control the shape and obtain the core particles;

(5) a shell layer forming step of adding the binder resin fine particles for shell that should form a shell layer to a dispersion liquid of the core particles, flocculating and fusing the binder resin fine particles for shell onto the core particle surface, to form particles having a core-shell structure;

(6) a second maturing step of maturing the particles having the core-shell structure by thermal energy to control the shape and obtain toner particles having the core-shell structure;

(7) a filtering and cleaning step of performing solid-liquid separation of the toner particles from a cooled dispersion system (water-based medium) of the toner particles, and removing a surfactant and the like from the toner particles; and (8) a drying step of drying the toner particles subjected to cleaning treatment.

After the drying step, the following step may be added as necessary:

(9) an external additive treatment step of adding an external additive to the toner particles subjected to drying treatment.

(1) Colorant Fine Particle Dispersion Liquid Preparing Step

In this step, a colorant is added to a water-based medium and the dispersion treatment is performed by a disperser, to prepare a dispersion liquid of colorant fine particles in which the colorant is dispersed in the form of fine particles.

Specifically, the dispersion treatment of the colorant is performed in the water-based medium having a surfactant concentration equal to or higher than a critical micelle concentration (CMC). The disperser used in the dispersion treatment is not particularly limited. However, preferable examples of the disperser include an ultrasonic disperser, a pressing disperser such as a mechanical homogenizer, Manton Gaulin and a pressure-type homogenizer, and a medium-type disperser such as a sand grinder, Goetzman Mill and Diamond Fine Mill. A dispersion diameter of the colorant fine particles in this colorant fine particle dispersion liquid is preferably 40 to 200 nm in a volume-based median diameter. This volume-based median diameter of the colorant fine particles is measured with "MICROTRAC UPA-150 (manufactured by HONEYWELL Corp.)" under the following measurement conditions:

sample refractive index: 1.59;

sample specific gravity: 1.05 (on a spherical particle basis);

solvent refractive index: 1.33;

solvent viscosity: 0.797 (30° C.), 1.002 (20° C.); and zero-point adjustment: the ion exchange water is put into a measurement cell and adjusted.

(2-1) Binder-Resin-Fine-Particles-for-Core Polymerizing Step

In this step, the polymerization treatment is performed to prepare a dispersion liquid of binder resin fine particles for core formed of a binder resin for core and including a primary wax and an internal additive. In one suitable example of the polymerization treatment in this step, a polymerizable monomer solution including a primary wax and an internal additive is added as necessary to a water-based medium including a surfactant having a concentration equal to or lower than a critical micelle concentration (CMC), and the mechanical energy is applied to form a liquid droplet, and then, a water-soluble polymerization initiator is added to advance the polymerization reaction in the liquid droplet. An oil-soluble polymerization initiator may be included in the liquid droplet. In the aforementioned step, the treatment of applying the mechanical energy to forcibly perform emulsification (formation of the liquid droplet) is indispensable. Examples of means for applying the mechanical energy can include means for applying the strong stirring or ultrasonic vibration energy such as a homomixer, ultrasonic waves, and Manton Gaulin.

(Surfactant)

The surfactants used in the water-based media used in the colorant fine particle dispersion liquid and used at the time of polymerizing the binder resin fine particles for core will be described. The surfactant is not particularly limited. However, suitable examples of the surfactant can include an ionic surfactant such as sulfonic acid salts (such as sodium dodecylbenzenesulfonate and sodium arylalkylpolyethersulfonate), sulfate ester salts (such as sodium dodecylsulfate, sodium tetradecylsulfate, sodium pentadecylsulfate, and sodium octylsulfate), and fatty acid salts (such as sodium oleate, sodium laurate, sodium caprate, sodium caprylate, sodium caproate, potassium stearate, and calcium oleate). A nonionic surfactant such as polyethylene oxide, polypropylene oxide, a combination of polypropylene oxide and polyethylene oxide, ester of polyethylene glycol and higher fatty acid, alkylphenol polyethylene oxide, ester of higher fatty acid and polyethylene glycol, ester of higher fatty acid and polypropylene oxide, and sorbitan ester can also be used. The polymerization initiator and the chain transfer agent used in the binder-resin-fine-particles-for-core polymerizing step will be described below.

(Polymerization Initiator)

Examples of the water-soluble polymerization initiator can include: persulfate such as potassium persulfate and ammonium persulfate; azobisaminodipropane acetate; azobiscyanovaleric acid and a salt thereof; hydrogen peroxide; and the like. Examples of the oil-soluble polymerization initiator include: an azo or diazo polymerization initiator such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; a peroxide-based polymerization initiator such as benzoyl peroxide, methylethylketone peroxide, diisopropylperoxycarbonate, cumene hydroperoxide, t-butylhydroperoxide, di-t-butylperoxide, dicumyl peroxide, 2,4-dichlorobenzoylperoxide, lauroyl peroxide, 2,2-bis-(4,4-t-butylperoxycyclohexyl)propane, and tris-(t-butylperoxy)triazine; a polymer initiator having peroxide in a side chain; and the like.

(Chain Transfer Agent)

A commonly-used chain transfer agent can be used in order to adjust a molecular weight of the obtained binder resin for core. The chain transfer agent is not particularly limited. For example, mercaptan such as n-octylmercaptan, n-decylmercaptan and tert-dodecylmercaptan, mercaptopropionate ester such as n-octyl-3-mercaptopropionate ester, terpinolene, a-methylstyrene dimer or the like is used.

(2-2) Binder-Resin-Fine-Particles-for-Shell Polymerizing Step

In this step, the polymerization treatment is performed similarly to the (2-1) binder-resin-fine-particles-for-core polymerizing step described above to prepare a dispersion liquid of binder resin fine particles for shell formed of a binder resin for shell.

(3) Flocculating and Fusing Step

In this step, the binder resin fine particles for core and the colorant fine particles are flocculated and fused in a water-based medium to form associated particles that should form core particles. A salting-out/fusing method using the colorant fine particles obtained in the (1) colorant fine particle dispersion liquid preparing step and the binder resin fine particles for core obtained in the (2-1) binder-resin-fine-particles-for-core polymerizing step is preferable as a flocculating and fusing method in this step. In this flocculating and fusing step, internal additive fine particles such as wax fine particles and a charge control agent can also be flocculated and fused, in addition to the binder resin fine particles for core and the colorant fine particles.

"Salting-out/fusing" herein refers to performing flocculation and fusing in parallel, and adding a flocculation stop agent and stopping the particle growth when the particles have grown to a desired particle size, and further, continuing heating for controlling the particle shape as necessary. In the salting-out/fusing method, a salting-out agent formed of an alkali metal salt, an alkaline-earth metal salt, a trivalent salt or the like is added, as a flocculant having a concentration equal to or higher than a critical flocculation concentration, to the water-based medium in which the binder resin fine particles for core and the colorant fine particles are present, and then, heating is performed to a temperature which is equal to or higher than a glass transition point of the binder resin fine particles for core and which is equal to or higher than a melting peak temperature of the binder resin fine particles for core and the colorant fine particles, thereby advancing salting-out and at the same time performing flocculation and fusing. As to the alkali metal salt and the alkaline-earth metal salt which are the salting-out agents, examples of the alkali metal include lithium, potassium, sodium and the like, and examples of the alkaline-earth metal include magnesium, calcium, strontium, barium and the like, and preferably potassium, sodium, magnesium, calcium, barium and the like.

When the (3) flocculating and fusing step is performed by salting-out/fusing, it is preferable to make as short as possible the time of being left after the salting-out agent is added. A reason for this is not clear. However, the flocculated state of the particles varies depending on the time of being left after salting-out, which causes problems such as unstable particle size distribution and variation in surface property of the fused toner. In addition, a temperature when adding the salting-out agent needs to be at least equal to or lower than the glass transition point of the binder resin fine particles for core. A reason for this is that if the temperature when adding the salting-out agent is equal to or higher than the glass transition point of the binder resin fine particles for core, salting-out/fusing of the binder resin fine particles for core progresses quickly, while particle size control cannot be performed, which causes problems such as generation of particles having a large particle size. This temperature may be any temperature as long as the temperature is equal to or lower than the glass transition point of the binder resin. However, the temperature is generally 5 to 55° C., and preferably 10 to 45° C.

The salting-out agent is added at a temperature equal to or lower than the glass transition point of the binder resin fine particles for core, and then, the temperature is raised as quickly as possible and heating is performed to a temperature which is equal to or higher than the glass transition point of the binder resin fine particles for core and which is equal to or higher than the melting peak temperature (° C.) of the binder resin fine particles for core and the colorant fine particles. The time that elapses before this temperature rise is preferably shorter than one hour. Furthermore, the temperature needs to be raised quickly and the temperature rise speed is preferably equal to or higher than 0.25° C./min. An upper limit of the temperature rise speed is not particularly clear. However, if the temperature is raised instantly, salting-out progresses suddenly and particle size control becomes difficult, and thus, the temperature rise speed is preferably equal to or lower than 5° C./min. By the aforementioned salting-out/fusing method, a dispersion liquid of the associated particles (core particles) formed by salting-out/fusing the binder resin fine particles for core and arbitrary fine particles is obtained. "Water-based medium" refers to a medium including 50 to 100 mass % of water and 0 to 50 mass % of a water-soluble organic solvent. Examples of the water-soluble organic solvent include methanol, ethanol, isopropanol, butanol, acetone, methyl ethyl ketone, tetrahydrofuran and the like. Among these, an alcohol-based organic solvent that does not dissolve the generated resin is preferable.

(4) First Maturing Step

In this step, the associated particles are matured by thermal energy. By controlling the heating temperature in the (3) flocculating and fusing step, and particularly the heating temperature and time in the (4) first maturing step, the surface of the core particles formed to have a constant particle size and to be narrowly distributed can be controlled to have a smooth but uniform shape. Specifically, in the (3) flocculating and fusing step, the heating temperature is set low to suppress the progress of fusion of the binder resin fine particles for core and promote uniformization, and in the first maturing step, the heating temperature is set low and the time is set long to control the surface of the core particles to have a uniform shape.

(5) Shell Layer Forming Step

In this step, the shell forming treatment is performed, in which a dispersion liquid of the binder resin fine particles for shell is added to the dispersion liquid of the core particles, and the binder resin fine particles for shell are flocculated and fused onto the surface of the core particles, and the binder resin fine particles for shell are coated onto the surface of the core particles, and thereby the particles having the core-shell structure are formed. This step is a preferable manufacturing condition for providing both the low-temperature fixation property and the heat-resistant storability. When a color image is formed, it is preferable to perform this shell layer formation in order to obtain high color reproducibility for secondary colors.

Specifically, with the heating temperatures in the (3) flocculating and fusing step and the (4) first maturing step being maintained, the dispersion liquid of the binder resin fine particles for shell is added to the dispersion liquid of the core particles, and the binder resin fine particles for shell are coated onto the surface of the core particles slowly for several hours while continuing heating and stirring, and thereby the particles having the core-shell structure are formed. The heating and stirring time is preferably 1 to 7 hours, and particularly preferably 3 to 5 hours.

(6) Second Maturing Step

In this step, when the particles having the core-shell structure reaches a prescribed particle size by the (5) shell layer forming step, a stop agent such as sodium chloride is added to stop the particle growth, and heating and stirring are still continued for several hours in order to fuse the binder resin fine particles for shell having adhered to the core particles. As a result, a thickness of a layer formed by the binder resin fine particles for shell that cover the surface of the core particles becomes 100 to 300 nm. In this manner, the binder resin fine particles for shell are fixed to the surface of the core particles to form the shell layer, and the toner particles having the core-shell structure of rounded and uniform shape are formed.

(7) Filtering and Cleaning Step

In this step, a dispersion liquid of the toner particles is first cooled. As a cooling treatment condition, it is preferable to cool the dispersion liquid of the toner particles at a cooling speed of 1 to 20° C./min. A cooling treatment method is not particularly limited, and examples of the cooling treatment method can include a method for cooling by introducing a coolant from outside a reaction vessel, and a method for cooling by directly putting the cold water into a reaction system. Next, solid-liquid separation of the toner particles from the dispersion liquid of the toner particles cooled to a prescribed temperature is performed, and then, the cleaning treatment for removing adherents such as the surfactant and the salting-out agent from the toner cake (aggregate obtained by flocculating the wet toner particles into a cake) subjected to solid-liquid separation is performed. A filtering treatment method is not particularly limited, and examples of the filtering treatment method can include a centrifugal separation method, a reduced-pressure filtering method using a Nutsche or the like, a filtering method using a filter press or the like, and other filtering methods.

(8) Drying Step

In this step, the toner cake subjected to cleaning treatment is dried. Examples of a dryer used in this step can include a spray dryer, a vacuum freeze dryer, a reduced-pressure dryer and the like, and it is preferable to use a stationary shelf dryer, a movable shelf dryer, a fluidized bed dryer, a rotary dryer, a stirring-type dryer or the like. A moisture content of the toner particles subjected to drying treatment is preferably equal to or lower than 5 mass %, and more preferably equal to or lower than 2 mass %. When the toner particles subjected to drying treatment are flocculated by the weak interparticle attraction, this agglomerate may be subjected to crushing treatment. A mechanical crushing apparatus such as a jet mill, a Henschel mixer, a coffee mill, and a food processor can be used as a crushing treatment apparatus.

(9) External Additive Treatment Step

In this step, an external additive is added to the toner particles subjected to drying treatment in the (8) drying step. As a method for adding the external additive, the external additive can be added by using, for example, a mechanical mixing apparatus such as a Henschel mixer and a coffee mill.

EXAMPLE

Hereinafter, the present invention will be described in more detail by way of Examples. However, the present invention is not limited thereto.

Examples 1 to 14 and Comparative Examples 1 to 4

By using a remodeled apparatus in which a fixing unit of an image forming apparatus (trade name: bizhub PRESS C1060 manufactured by Konica Minolta, Inc.) was removed, a solid pattern (an amount of adherence onto a paper was 8.0 g/m$^2$) was formed on a coated paper (trade name: OK Top Coat+ manufactured by Oji Paper Corp.). In the image forming apparatus, a conveyance speed of the coated paper was 200 mm/sec. Toner A (styrene-acrylic toner fabricated by the toner manufacturing method described above) or toner B (styrene-acrylic toner fabricated by the toner manufacturing method described above) was used as toner. A type of the toner used in each Example is as shown in Table 1. A releasing agent included in toner A was a polyester wax and melting point $T_a$ thereof was 70° C. In addition, $T_b$, which is a temperature at which an elastic modulus of toner A is $1\times10^4$ Pa, was 110° C. A releasing agent included in toner B was a polyester wax and melting point $T_a$ thereof was 80° C. In addition, $T_b$, which is a temperature at which an elastic modulus of toner B is $1\times10^4$ Pa, was 124° C. $T_b$ was obtained by viscoelasticity measurement described above.

Thereafter, the coated paper having a toner image formed thereon was brought through the fixing device shown in any one of FIGS. 1 to 5 or a one-stage fixing device (Comparative Example 1) at a conveyance speed of 200 mm/sec. A type of the fixing device used in each Example and each Comparative Example is as shown in Table 1. Temperature $T_{11}$ of the first fixing member, temperature $T_{12}$ of the first pressing member, temperature $T_{21}$ of the second fixing member, and the pressure applied to the recording medium in first fixing portion 20 were controlled to the temperatures and the pressures shown in Table 1. In addition, the temperature of the second pressing member was controlled to be 180° C.

Fixing device 1 shown in FIG. 1 was used under the conditions that a nip width in the first fixing portion was 20 mm, a nip width in the second fixing portion was 20 mm, and a nip-to-nip distance between the first fixing portion and the second fixing portion was 120 mm. Fixing device 2 shown in FIG. 2 was used under the conditions that a nip width in the first fixing portion was 20 mm, a nip width in the second fixing portion was 20 mm, and a nip-to-nip distance between the first fixing portion and the second fixing portion was 180 mm. Fixing device 3 shown in FIG. 3 was used under the conditions that a nip width in the first fixing portion was 22 mm, a nip width in the second fixing portion was 22 mm, and a nip-to-nip distance between the first fixing portion and the second fixing portion was 180 mm. Fixing device 4 shown in FIG. 4 was used under the conditions that a perimeter of belt 43 was 420 mm and an outer diameter of pressing roller 71 was 120 mm. Fixing device 5 shown in FIG. 5 was used under the conditions that a perimeter of belt 43 was 380 mm and an outer diameter of pressing roller 71 was 120 mm. A one-stage fixing device configured to include only second fixing portion 30 of fixing device 1 shown in FIG. 1 was used as the one-stage fixing device (Comparative Example 1).

[Evaluation]

(Temperature Measurement)

For Examples 1 to 10 and Comparative Examples 2 to 4, in each of which fixing device 1 shown in FIG. 1 was used, maximum temperature $T_{13}$ (° C.) of a surface of the coated paper when the coated paper passed through the first fixing portion, and maximum temperature $T_{23}$ (° C.) of the surface of the coated paper when the coated paper passed through the second fixing portion were obtained by the infrared temperature sensor. These were obtained by preliminarily identifying a position where the maximum temperature was reached, and detecting a temperature at this position by the infrared sensor. In addition, for Examples 11 to 14 and Comparative Example 1, maximum temperature $T_{23}$ (° C.) of the surface of the coated paper when the coated paper passed through the second fixing portion was obtained by the infrared temperature sensor. This was obtained by preliminarily identifying a position where the maximum temperature was reached, and detecting a temperature at this position by the infrared sensor. The result is shown in Table 1. It was preliminarily confirmed that, when $T_{11}$ and $T_{12}$ in the first fixing portion were identical, the temperature of the surface of the coated paper having passed through the first fixing portion in the case of using the fixing device shown in any one of FIGS. 2 to 5 was almost identical to the temperature of the surface of the coated paper having passed through the first fixing portion in the case of using fixing device 1 shown in FIG. 1, and a difference was within the range of ±2° C. Therefore, for Examples 11 to 14, temperature $T_{13}$ of the surface of the coated paper having passed through the first fixing portion was shown in Table 1 as a predicted value, based on temperature $T_{13}$ for Examples 1 to 10.

(Fixation and Separation Property)

In Examples 1 to 14 and Comparative Examples 1 to 4, a state when the coated paper was ejected from the fixing device was observed and evaluation was performed on a scale of A to C described below. The evaluation result is shown in Table 1.

A: The image plane did not wind around the second fixing member (or the belt laid over the second fixing member), and no jamming occurred at the time of separation.

B: The image plane slightly wound around the second fixing member (or the belt laid over the second fixing member), while no jamming occurred at the time of separation.

C: The image plane wound around the second fixing member (or the belt laid over the second fixing member), and jamming occurred at the time of separation.

(Fixation Strength)

The image portion of the image on the coated paper obtained in each of Examples 1 to 14 and Comparative Examples 1 to 4 was rubbed twice with an eraser (sand eraser, "LION26111" manufactured by Lion Office Products Corp.) at a pressing load of 1 kgf, and an image concentration residual ratio was measured by a reflection densitometer (product name: X-Rite model 404 manufactured by X-Rite Corp.), and evaluation was performed on a scale of A to C described below. The evaluation result is shown in Table 1.

TABLE 1

| | | Example 1 | Example 2 | Example 3 | Example 4 | Example 5 | Example 6 | Example 7 | Example 8 | Example 9 |
|---|---|---|---|---|---|---|---|---|---|---|
| Fixing Conditions | Configuration | FIG. 1 | FIG. 1 | FIG. 1 | FIG. 1 | FIG. 1 | FIG. 1 | FIG. 1 | FIG. 1 | FIG. 1 |
| | T11 | 100° C. | 100° C. | 100° C. | 120° C. | 140° C. | 120° C. | 120° C. | 100° C. | 100° C. |
| | T12 | 80° C. | 100° C. | 120° C. | 80° C. | 80° C. | no heater | 80° C. | 80° C. | 80° C. |
| | Pressure | 300 kPa | 300 kPa | 300 kPa | 300 kPa | 300 kPa | 300 kPa | 400 kPa | 200 kPa | 500 kPa |
| | T21 | 180° C. | 180° C. | 180° C. | 180° C. | 180° C. | 180° C. | 180° C. | 180° C. | 180° C. |
| Toner | Type | A | A | A | A | A | A | B | A | A |
| | Ta | 70° C. | 70° C. | 70° C. | 70° C. | 70° C. | 70° C. | 80° C. | 70° C. | 70° C. |
| | Tb | 110° C. | 110° C. | 110° C. | 110° C. | 110° C. | 110° C. | 124° C. | 110° C. | 110° C. |
| Evaluation Result | Separation Property | A | A | B | B | B | B | A | B | A |
| | Fixation Strength | B | A | A | A | A | B | A | B | B |
| | T13 | 88° C. | 94° C. | 101° C. | 102° C. | 107° C. | 72° C. | 105° C. | 86° C. | 88° C. |
| | T23 | 156° C. | 162° C. | 166° C. | 167° C. | 170° C. | 158° C. | 168° C. | 155° C. | 156° C. |

| | | Example 10 | Example 11 | Example 12 | Example 13 | Example 14 | Comparative Example 1 | Comparative Example 2 | Comparative Example 3 | Comparative Example 4 |
|---|---|---|---|---|---|---|---|---|---|---|
| Fixing Conditions | Configuration | FIG. 1 | FIG. 2 | FIG. 3 | FIG. 4 | FIG. 5 | one-stage fixing | FIG. 1 | FIG. 1 | FIG. 1 |
| | T11 | 100° C. | 120° C. | 120° C. | 140° C. | 120° C. | none | 120° C. | 140° C. | 68° C. |
| | T12 | 80° C. | 80° C. | 100° C. | 80° C. | 80° C. | none | 120° C. | 100° C. | 68° C. |
| | Pressure | 1000 kPa | 300 kPa | 300 kPa | 300 kPa | 300 kPa | 300 kPa | 300 kPa | 300 kPa | 300 kPa |
| | T21 | 180° C. | 180° C. | 180° C. | 180° C. | 180° C. | 180° C. | 180° C. | 180° C. | 180° C. |
| Toner | Type | A | A | A | A | A | A | A | A | A |
| | Ta | 70° C. | 70° C. | 70° C. | 70° C. | 70° C. | 70° C. | 70° C. | 70° C. | 70° C. |
| | Tb | 110° C. | 110° C. | 110° C. | 110° C. | 110° C. | 110° C. | 110° C. | 110° C. | 110° C. |
| Evaluation Result | Separation Property | A | A | A | A | A | C | C | C | C |
| | Fixation Strength | B | A | A | A | A | C | A | A | C |
| | T13 | 89° C. | 102 ± 2° C. | 106 ± 2° C. | 107 ± 2° C. | 102 ± 2° C. | — | 112° C. | 111° C. | 64° C. |
| | T23 | 157° C. | 169° C. | 167° C. | 170° C. | 169° C. | 146° C. | 172° C. | 172° C. | 149° C. |

A: The image concentration residual ratio was equal to or higher than 90%.
B: The image concentration residual ratio was equal to or higher than 80% and lower than 90%.
C: The image concentration residual ratio was lower than 80%.

<Discussion>

In Examples 1 to 14, the relationship of "$T_a \leq T_{13} < T_b$" is satisfied in the first fixing portion and the relationship of "$T_{23} \geq T_b$" is satisfied in the second fixing portion, and thus, the excellent fixation and separation property and the excellent fixation strength are obtained. On the other hand, in Comparative Example 1 which does not have the first fixing portion and in Comparative Examples 1 to 3 in which the relationship of "$T_a \leq T_{13} < T_b$" is not satisfied in the first fixing portion, the fixation and separation property is poor.

While the embodiments of the present invention have been described, it should be understood that the embodiments disclosed herein are illustrative and not limitative in any respect. The scope of the present invention is defined by the terms of the claims, and is intended to include any modifications within the scope and meaning equivalent to the terms of the claims.

What is claimed is:

1. A fixing device for fixing a toner image formed on a surface of a recording medium by toner, wherein the toner includes a releasing agent and satisfies $T_a < T_b$, where $T_a$ (° C.) represents a melting point of the releasing agent and $T_b$ (° C.) represents a temperature at which an elastic modulus of the toner is $1 \times 10^4$ Pa, the fixing device comprises a first fixing portion and a second fixing portion in this order along a conveyance direction of the recording medium, the first fixing portion presses and heats the toner image such that a maximum temperature $T_{13}$ (° C.) of the surface of the recording medium satisfies $T_a \leq T_{13} < T_b$, and the second fixing portion presses and heats the toner image such that a maximum temperature $T_{23}$ (° C.) of the surface of the recording medium satisfies $T_{23} \geq T_b$.

2. The fixing device according to claim 1, wherein in the first fixing portion, a pressure applied to the recording medium is 300 kPa to 1000 kPa.

3. The fixing device according to claim 1, wherein the first fixing portion includes a first fixing member arranged on a front surface side of the recording medium, and a first pressing member arranged on a rear surface side of the recording medium, and the first fixing member and the first pressing member nip and convey the recording medium, and the second fixing portion includes a second fixing member arranged on the front surface side of the recording medium, and a second pressing member arranged on the rear surface side of the recording medium, and the second fixing member and the second pressing member nip and convey the recording medium.

4. The fixing device according to claim 3, wherein temperatures of the first fixing member and the first pressing member are adjustable, and the temperature $T_{11}$ (° C.) of the first fixing member and the temperature $T_{12}$ (° C.) of the first pressing member are adjusted to satisfy $T_{11}>T_{12}$.

5. The fixing device according to claim 3, wherein a temperature of the second fixing member is adjustable, and the temperature $T_{21}$ (° C.) of the second fixing member is adjusted to satisfy $T_{21}\geq T_b$.

6. The fixing device according to claim 3, further comprising an interposed member that is in contact with the first fixing member and the second fixing member.

7. The fixing device according to claim 6, wherein the interposed member is an endless belt, and in the first fixing portion and the second fixing portion, the recording medium is conveyed, with the interposed member abutting the surface of the recording medium.

8. The fixing device according to claim 6, wherein each of the first fixing portion, the second fixing portion and the interposed member is a roller.

9. An image forming apparatus comprising the fixing device as recited in claim 1.

10. A fixing method for fixing a toner image formed on a recording medium by toner, wherein the recording medium is conveyed in the order of a first fixing step and a second fixing step, so that the toner image is fixed, the toner includes a releasing agent and satisfies $T_a<T_b$, where $T_a$ (° C.) represents a melting point of the releasing agent and $T_b$ (° C.) represents a temperature at which an elastic modulus of the toner is $1\times10^4$ Pa, in the first fixing step, the toner image is pressed and heated such that a maximum temperature $T_{13}$ (° C.) of a surface of the recording medium satisfies $T_a\leq T_{13}<T_b$, and in the second fixing step, the toner image is pressed and heated such that a maximum temperature $T_{23}$ (° C.) of the surface of the recording medium satisfies $T_{23}\geq T_b$.

11. The fixing method according to claim 10, wherein in the first fixing step, a pressure applied to the recording medium is 300 kPa to 1000 kPa.

12. The fixing method according to claim 11, wherein in the first fixing step, the recording medium is nipped and conveyed by a first fixing member arranged on a front surface side of the recording medium and a first pressing member arranged on a rear surface side of the recording medium, and in the second fixing step, the recording medium is nipped and conveyed by a second fixing member arranged on the front surface side of the recording medium and a second pressing member arranged on the rear surface side of the recording medium.

13. The fixing method according to claim 12, wherein temperatures of the first fixing member and the first pressing member are adjustable, and in the first fixing step, the temperature $T_{11}$ (° C.) of the first fixing member and the temperature $T_{12}$ (° C.) of the first pressing member are adjusted to satisfy $T_{11}>T_{12}$.

14. The fixing method according to claim 12, wherein a temperature of the second fixing member is adjustable, and in the second fixing step, the temperature $T_{21}$ (° C.) of the second fixing member is adjusted to satisfy $T_{21}>T_b$.

* * * * *